United States Patent [19]

Takemoto

[11] Patent Number: 4,505,604

[45] Date of Patent: Mar. 19, 1985

[54] HAMMER DEVICE OF PRINTER

[75] Inventor: Takeshi Takemoto, Yamato, Japan

[73] Assignee: Ricoh Company, Ltd., Japan

[21] Appl. No.: 343,480

[22] Filed: Jan. 28, 1982

[30] Foreign Application Priority Data

Jan. 28, 1981 [JP] Japan ..... 56-9580[U]

[51] Int. Cl.[3] ..... B41J 1/30

[52] U.S. Cl. ..... 400/144.2; 101/93.48; 400/157.2

[58] Field of Search ..... 400/144.2, 157.1, 157.2, 400/496, 144.3; 101/93.09, 93.32, 93.33, 93.34, 93.48; D18/22

[56] References Cited

U.S. PATENT DOCUMENTS

| | | | |
|---|---|---|---|
| D. 245,286 | 8/1977 | Osterlund et al. | D18/22 |
| 4,236,842 | 12/1980 | Dick et al. | 400/144.3 |
| 4,294,555 | 10/1981 | Galaske et al. | 400/496 X |
| 4,308,794 | 1/1982 | Adamoli et al. | 400/144.2 X |
| 4,319,849 | 3/1982 | Dollenmayer | 400/144.3 |
| 4,338,035 | 7/1982 | Kondo et al. | 400/144.2 |

FOREIGN PATENT DOCUMENTS

| | | | |
|---|---|---|---|
| 142316 | 6/1980 | Fed. Rep. of Germany | 400/157.2 |

OTHER PUBLICATIONS

"Self-Cooled Print Hammer"; R. D. Mathews; *IBM Technical Disclosure Bulletin;* vol. 22, No. 4, p. 1318; 9/1979.

*Primary Examiner*—Edgar S. Burr
*Assistant Examiner*—David A. Wiecking
*Attorney, Agent, or Firm*—Guy W. Shoup

[57] ABSTRACT

A hammer device including a striking member supported in a support frame for axial reciprocatory movement for striking a type member supported on one of fingers of a petal type print wheel of a printer at the back, and a guide member for guiding the striking member in its axial reciprocatory movement while preventing same rotation on its own axis mounted in a forward portion of the support frame.

Fabrication and assembling of the striking member having rotation prevented by the guide member can be facilitated as compared with those of a striking member of the prior art having its rotation prevented by a bearing shaped to have a cross-sectional shape of an incomplete circle. This is conducive to increased quality of the printed characters and prolonged service life of the hammer device.

7 Claims, 29 Drawing Figures

HAMMER DEVICE OF PRINTER

FIELD OF THE INVENTION

This invention relates to a hammer device suitable for use with a serial impact printer provided with a petal type print wheel, and more particularly it is concerned with a hammer device of the plunger type suitable for use with the petal type print wheel.

DESCRIPTION OF THE PRIOR ART

Figure 1:
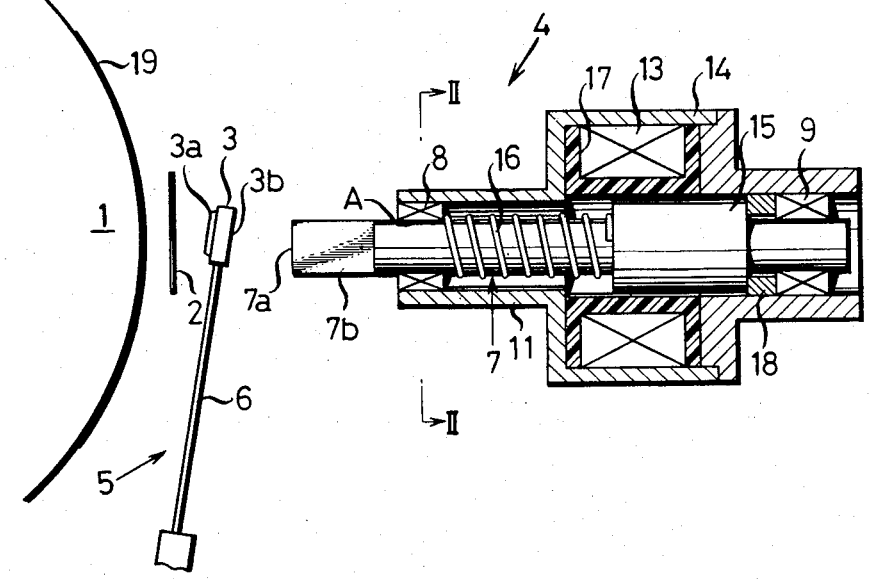
FIG.1 PRIOR ART
FIG. 1 is a sectional side view of a hammer device of the prior art.

Generally, a serial impact printer comprises a platen 1 against which are positioned an ink ribbon 2, a type member 3 and a hammer device 4 in the indicated order as shown in FIG. 1. The type member 3 is located at the upper end of a finger 6 of a petal type print wheel 5 and includes a type face 3*a* which is juxtaposed against the platen 1. The hammer device 4 comprises a striking member 7 for pressing against a back 3*b* of the type member 3, bearings 8 and 9 arranged in the front and rear respectively of the hammer device 4 for journalling the striking member 7, a cylindrical member 11 having the bearing 8 fitted in its forward end, a magnet coil 13 arranged at the back of the cylindrical member 11, a yoke 14 enclosing the magnet coil 13 formed integrally with the cylindrical member 11, a plunger 15 located in the hammer device 4 for reciprocatory movement (leftwardly and rightwardly in FIG. 1) formed integrally with the striking member 7, and a compression spring 16 interposed between the plunger 15 and the bearing 8 for normally urging by its biasing force the plunger 15 to move rearwardly (rightwardly in FIG. 1). The numeral 17 designates a bobbin formed of an insulating material, such as plastics, on which the magnet coil 13 is wound, and the numeral 18 designates a damper formed of rubber for keeping the rearwardly moved plunger 15 from bouncing.

Operation of the hammer device 4 of the aforesaid construction will be outlined. A printing operation starts with energization of the magnet coil 13. Energization of the magnet coil 13 enables the plunger 15 to move forwardly by overcoming the biasing force of the compression spring 16, so that the plunger 15 moves leftwardly in FIG. 1 along with the striking member 7. Thus the forwardly moving striking member 7 strikes at its striking surface 7*a* at its forward end the type member 3 on the back 3*b* thereof, so as to thereby force the type face 3*a* of the type member 3 against the surface of paper 19 on the platen 1 through the ribbon 2 to enable printing to be carried out by the type member 3.

Figure 2:
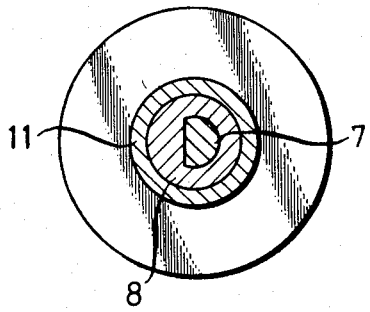
FIG.2 PRIOR ART
FIG. 2 is a sectional view taken along the line II—II in FIG. 1.

In this case, in order to increase the quality of the character printed on the paper 19, it is necessary to increase the area of contact between the striking surface 7*a* and the back 3*b* of the type member 3. To this end, a forward end portion 7*b* of the striking member 7 is shaped such that its forward end surface or the striking surface 7*a* is rectangular in shape and has the same dimensions as the largest type member on the print wheel 5. Thus in the event that the striking member 7 rotates on its own axis, there would arise the trouble that the striking surface 7*a* striking against the back 3*b* of one type member 3 also strikes the adjacent type member. To avoid this trouble, it has hitherto been usual practice to form a sliding surface A on the striking member 7 in contact with the bearing 8 in the shape of an incomplete circle as shown in FIG. 2 which is a sectional view taken along the line II—II in FIG. 1.

Upon completion of the printing operation, the magnet coil 13 shown in FIG. 1 is de-energized, so that the striking member 7 is moved, together with the plunger 15, by the biasing force of the compression spring 16 rearwardly or rightwardly in the figure to its original position.

In the hammer device of the prior art shown and described hereinabove, the bearing 8 has its inner surface formed in the shape of an incomplete circle. Difficulties have hitherto been experienced in producing the bearing 8 of this shape with a high degree of precision. Thus the bearing 8 is required to perform not only the function of journalling the striking member 7 in its forward and backward movements but also the function of preventing rotation thereof on its own axis. This places limitations on the material for producing the bearing 8, and moreover the bearing 8 having a cross-sectional shape of an incomplete circle is low in durability and therefore unable to maintain the quality of the printed character at a high level over a prolonged period of time.

Thus as described hereinabove, the aforesaid trouble is unavoidable in the hammer device of the prior art because of the fact that the bearing is made to perform the function of preventing rotation of the striking member about its own axis.

SUMMARY OF THE INVENTION

This invention has been developed for the purpose of obviating the aforesaid disadvantages of the prior art. Accordingly the invention has as its object the provision of a hammer device easy to produce which is capable of maintaining the quality of the printed character at a high level over a prolonged period of time.

The aforesaid object is accomplished according to the invention by providing a guide member to the forward end of a support frame, which corresponds to the cylindrical member 11 of the hammer device of the prior art, for supporting a striking member, so that the striking member is kept from rotating on its own axis by the guide member, not by the bearing as is the case with the prior art. In the invention, the bearing can be formed to have a circular cross-sectional shape, so that it is readily formed with a high degree of precision and can have a long service life. This makes it possible to produce the hammer device readily and positively, to raise the level of the quality of the printed characters, and to prolong the service life thereof. Since the function of avoiding the rotation of the striking member is performed by the guide member, the bearing has only to perform its essential function of journalling the striking member in its sliding reciprocatory movement. Thus the load applied to the bearing is greatly reduced and the service life of the hammer device can be prolonged.

The provision of a protector to the forward end of the support frame for guiding the finger of the print wheel stabilizes the movement of the finger and ensures that the printed character has high quality. The protector may be formed with a guide for preventing the rotation of the striking member.

DESCRIPTION OF THE PREFERRED EMBODIMENTS

Figure 3:
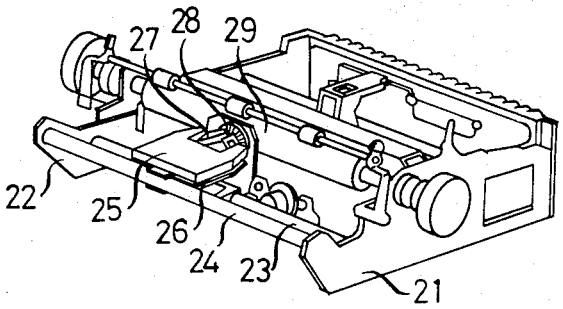
FIG. 3 is a perspective view of a printer in its entirety incorporating therein the hammer device according to the invention.

Referring to FIG. 3, the printer comprises side plates 21 and 22 which support two guide rods 23 and 24 parallel to each other and arranged at different levels to support for reciprocatory movement a carrier 26 supporting a ribbon cartridge 25 thereon. The carrier 26 has mounted thereon a carriage 27 which in turn removably mounts at its forward end a petal type print wheel 28 of the disc shape. Located substantially in the central portion of the printer between the two side plates 21 and 22 is a platen 29 which is parallel to the guide rods 23 and 24. The hammer device according to the invention is arranged on the carriage 27 in a position slightly posterior to the print wheel 28 and performs the function of forcing type members on the print wheel 28 against the paper, not shown, on the platen 29. The details of the hammer device are subsequently to be described.

Figure 4:
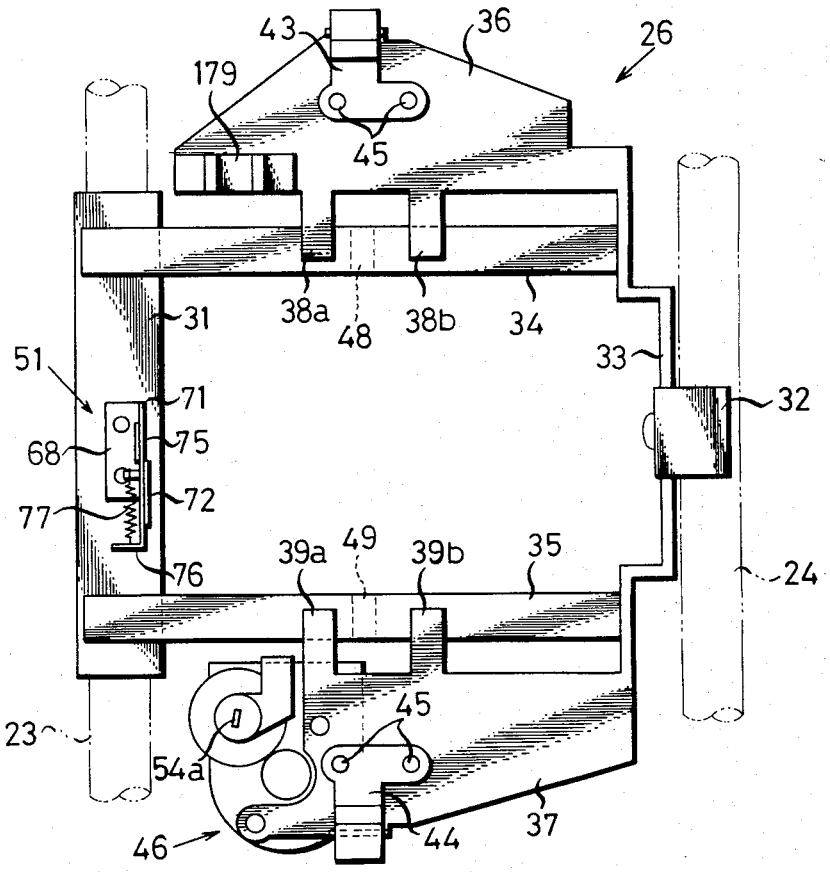
FIG. 4 is a plan view of the carrier of the printer shown in FIG. 3.
Figure 5:
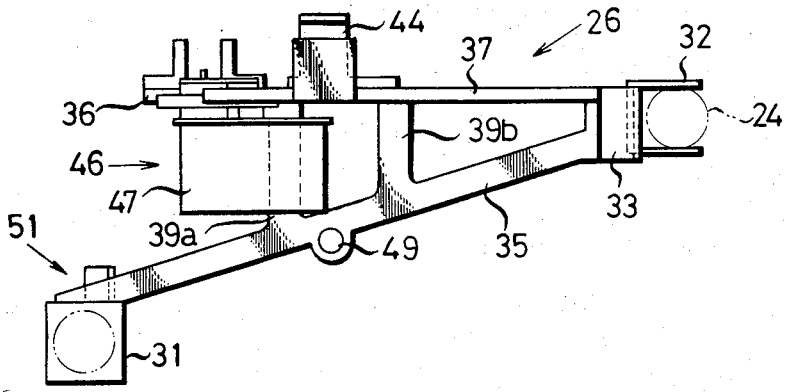
FIG. 5 is a side view of the carrier shown in FIG. 4.

Referring to FIG. 4 or 5, the carrier 26 comprises a slide member 31 slidable on the lower guide rod 23 shown in dash-and-dot lines, an engaging member 32 in the form of a letter U in a lying position capable of engaging the upper guide rod 24 shown in dash-and-dot lines, a rear plate 33 having the engaging member 32 secured thereto, two beams 34 and 35 connecting the rear plate 33 to the slide member 31, and support plates 36 and 37 integral with the rear plate 33 and extending in the same direction as the slide member 31. Ribs 38*a* and 38*b* connect the support plate 36 to the beam 34, and ribs 39*a* and 39*b* connect the support plate 37 to the beam 35.

Figure 6:
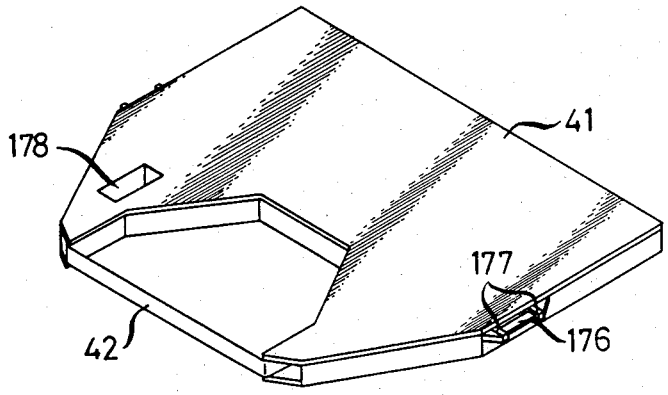
FIG. 6 is a perspective view of the ribbon cartridge used with the printer shown in FIG. 5.

FIG. 6 shows a ribbon cartridge 41 secured to the support plates 36 and 37 in such a manner that a ribbon 42 faces the lower guide rod 23. The support plates 36 and 37 have secured to the surfaces thereof a cartridge securing members 43 and 44 formed of flexible material, such as synthetic resinous material, and secured in place by pins 45, to hold the ribbon cartridge 41 in place. The numeral 46 designates ribbon feed means comprising a rotary magnet 47 for intermittently moving the ribbon 42 in the ribbon cartridge 41 securedly supported on the support plates 36 and 37. Openings 48 and 49 formed in the beams 34 and 35 respectively are intended to lock in place the carriage 27 shown in FIG. 3. The numeral 51 designates carriage setting means located on the slide member 31 to perform the function of supporting the carriage 27 rotatably mounted on the carrier 26 in the printing position.

Figure 7:
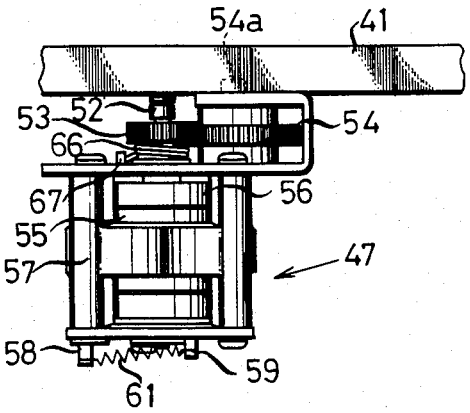
FIG. 7 is a side view of the ribbon feed means for feeding a ribbon contained in the ribbon cartridge shown in FIG. 6.

The ribbon feed means will be described by referring to FIG. 7. The numeral 47 designates a rotary magnet serving as a drive source for feeding the ribbon 42 (FIG. 6) contained in the ribbon cartridge 41. The rotary magnet 47 is supported on a rotor shaft 52 mounting at its upper portion a rotor gear 53 in meshing engagement with a feed gear 54 for transmitting rotation to the ribbon feed mechanism, not shown, in the ribbon cartridge 41. The feed gear 54 has at the forward end of its center axis a feed claw 54*a*, so that the feed gear 54 is connected to the ribbon feed mechanism in the ribbon cartridge 41 through the feed claw 54*a*.

The rotary magnet 47 comprises a rotor 56 having a coil 55 wound thereon and formed with a plurality of magnetic poles, and a stator 57 located around the rotor 56 and formed with a plurality of magnetic poles different in polarity from the magnetic poles of the rotor 56 to have a magnetic action on the rotor 56. The rotary magnet 47 further has a pin 58 projecting downwardly from its bottom, and a slot, not shown, disposed in spaced-apart relation to the pin 58 and receiving another pin 59 extending from the bottom of the rotor 56. A tension spring 61 is mounted between the two pins 58 and 59 so that the rotor 56 is normally urged by the biasing force of the spring 61 toward the pin 58. When no current is passed to the stator 57, no magnetic field is formed between the magnetic poles of the stator 57 and those of the rotor 56, so that the rotor 56 is biased by the spring 61 toward the pin 58. Upon a current being passed to the coil 55, a magnetic force is generated between the magnetic poles of the rotor 56 and stator 57 to enable the rotor 56 to overcome the biasing force of the tension spring 61 to rotate in one direction. Upon interrupting the supply of the current to the coil 55, the rotor 56 is urged by the biasing force of the spring 61 and rotates in the other direction. Thus as a current is intermittently fed to the coil 55, the rotary magnet 47 moves in rotary reciprocatory movement within the range allowed by the lengthwise dimension of the slot at the bottom of the rotary magnet 47.

Figure 8:
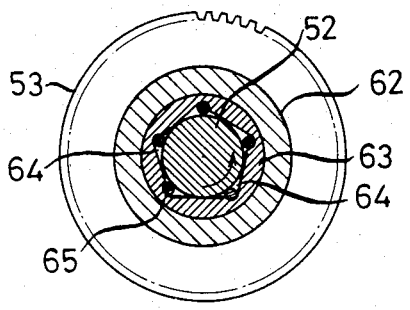
FIG. 8 is a sectional plan view of the ribbon feed means shown in FIG. 7, showing its essential portions.
Figure 9:
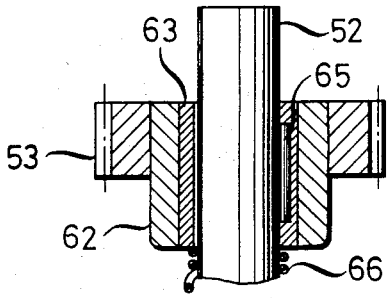
FIG. 9 is a sectional side view of the essential portions of the ribbon feed means shown in FIG. 8.

Referring to FIGS. 8 and 9, the rotor gear 53 of the rotary magnet 47 has on its inner periphery a mounting portion formed on its inner wall surface 63 with a plurality of recesses 64 each having a roller 65 rotatably mounted therein. The recesses 64 are constructed such that as the rotor shaft 52 rotates in one direction (in the direction of an arrow in the figure) under the influence of the aforesaid magnetic force, the rollers 65 are drawn between the rotor shaft 52 and the mounting portion 62 of the rotor gear 53 or the recesses 64 have their depths reduced in the direction of the arrow or in the direction in which the rotor shaft 52 rotates. Meanwhile the mounting portion 62 of the rotor gear 53 has wound on its lower end a spring 66 which has its base attached to a locking portion 67 on the surface of the rotary magnet 47 and urges the mounting portion 62 to move in a direction opposite the direction of the arrow. Thus the spring 66 is unwound as the rotor gear 53 rotates as subsequently to be described so as not to interfere with the rotation of the gear wheel 53 and restricts the rotation of the gear wheel 53 in the opposite direction.

The ribbon feed means thus includes two clutches, one clutch using the rotor gear 53 and the other clutch using the spring 66. In the ribbon feed means of this construction, as a current is passed to the coil 55 of the rotor 56 and the rotor 56 rotates in the direction of the arrow, rotation of the rotor shaft 52 draws the rollers 65 between the rotor shaft 52 and rotor gear 53, to transmit rotation of the rotor shaft 52 to the rotor gear 53 which transmits the rotation to the ribbon feed mechanism in the ribbon cartridge 41 through the feed gear 54. Thus the ribbon is fed by one character. As the current being passed to the coil 55 of the rotor 56 is interrupted and the biasing force of the tension spring 61 causes the rotor 56 to rotate in the opposite direction, the rotation of the rotor shaft 52 in the opposite direction withdraws the rollers 65 from the recesses 64 as they rotate along the rotor shaft 52, thereby keeping the rotation of the rotor shaft 52 from being transmitted to the rotor gear 53. At this time, as the rollers 65 are withdrawn from the recesses 64, a frictional force may be generated between the rollers 65 and the recesses 64 of the mounting portion 62. Even if such frictional force is generated, there is no risk of the rotation of the rotor shaft 52 being transmitted to the rotor gear 53 and causing the rotor gear 53 to mesh with the feed gear 54 to return the ribbon to the original position, because the mounting portion 62 is urged by the biasing force of the spring 66 to move in a direction in which the rollers 65 are released from engagement with the recesses 64. The ribbon 42 in the ribbon cartridge is fed intermittently in the manner described hereinabove.

Figure 10:
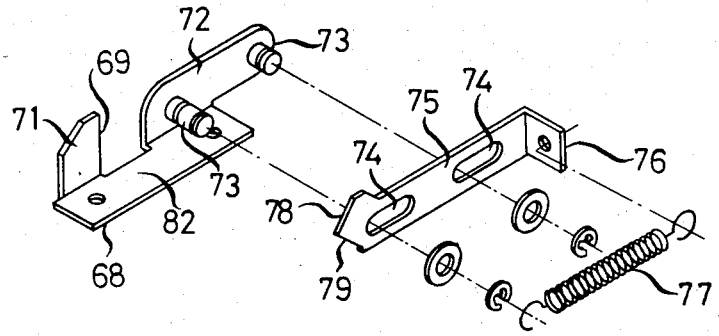
FIG. 10 is an exploded perspective view of the carriage setting means.
Figure 14:
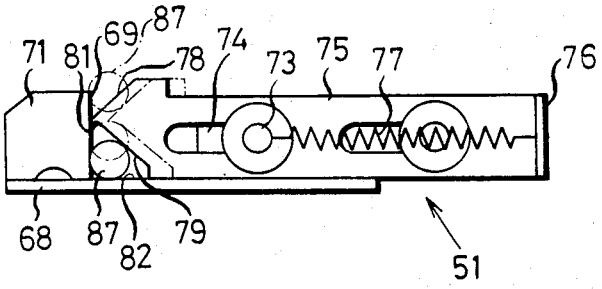
FIG. 14 is a side view of the carriage setting means shown in FIG. 11.

The carriage setting means 51 will be described by referring to FIG. 10. As shown, a base plate 68 in the form of a letter L is secured on the slide member 31 of the carrier 26 and includes a base 71 having a vertical reference surface 69 and a holder 72 displaced rewardly of the base 71 by an amount corresponding to the thickness of the plate. The holder 72 has secured thereto two guide pins 73 extending forwardly, and a movable piece 75 formed with horizontal slots 74 adapted to receive the pins 73 respectively is disposed along the holder 72. The movable piece 75 is biased forward the base 71 by a tension spring 77 mounted between a bent portion 76 at one end of the movable piece 75 and one of the guide pins 73. The movable piece 75 is formed at an end portion opposite the bent piece 76 with an upper inclined surface 78 and a lower inclined surface 79, the lower inclined surface 79 having a flat edge portion 81 of a small area formed at its forward end (FIG. 14). The base plate 68 has on its surface a reference surface 82 for the lower end of an engaging pin presently to be described.

Figure 11:
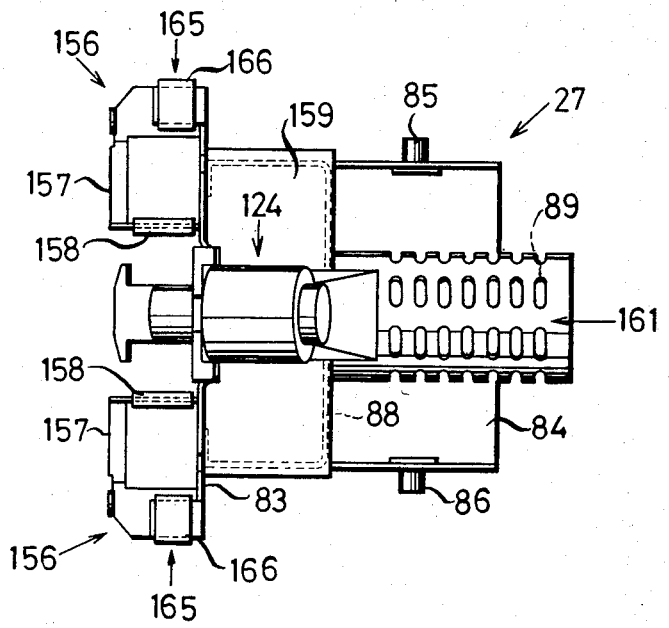
FIG. 11 is a plan view of carriage used with the printer shown in FIG. 3.
Figure 12:
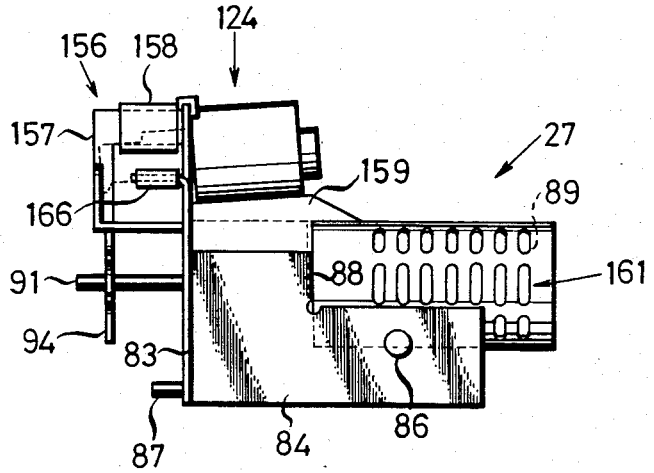
FIG. 12 is a side view of the carriage shown in FIG. 11.
Figure 13:
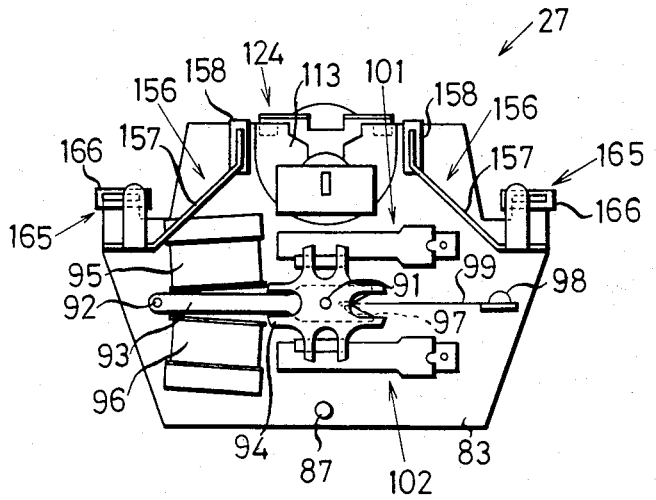
FIG. 13 is a front view of the carriage shown in FIG. 12.

The carriage 27 (FIG. 3) is supported in the carrier 26 of the aforesaid construction. The details of the carriage 27 are shown in FIGS. 11–13, wherein a front plate 83 has connected thereto a frame 84 extending rearwardly therefrom and having two side plates supporting thereon outwardly extending shafts 85 and 86 fitted in apertures 48 and 49 (FIG. 4) respectively formed in the carrier 26, so as to thereby pivotably connect the carriage 27 to the carrier 26. The front plate 83 has connected to its lower portion a pin 87 which engages the carriage setting means 51 described hereinabove so as to thereby hold the carriage 27 pivotally supported by the carrier 26 in a printing position. The operation to accomplish this object will be described by referring to FIG. 14.

As the carriage 27 supported by the carrier 26 is moved downwardly, the pin 87 (in a dash-and-dot line position) causes a movable member 75 to move rearwardly and then the pin 87 (in a solid line position) abuts against a horizontal reference surface 82. As the pin 87 abuts against the horizontal reference surface 82, it is pressed at the same time against a reference surface 69 of a base member 71 by an inclined surface 79 of the movable member 75, thus the pin 87 or the carriage 27 has its position accurately set both in vertical and horizontal direction, so that the carriage 27 is accurately held in the printing position. When it is desired to move the carriage 27 upwardly after releasing it from the printing position, one has only to move the carriage 27 upwardly. This automatically causes the movable member 75 to move rearwardly and allows the carriage 27 to be released from the printing position. Since the movable member 75 is formed with a flat edge 81, the upward movement of the carriage 27 produces a click and gives the operator the feel that the carriage 27 has snapped into position. The provision of the setting means provided with the aforesaid flat edge 81 to a printer of the type in which the lines are changed by slightly moving the carriage upwardly prevents the carriage being pushed upwardly by inertia when it is moved upwardly by the operator.

In the carriage 27 that can be held in the printing position as described hereinabove, a motor 89 is mounted on an intermediate plate 88 of a frame 84 having connected to its output shaft through a universal joint, not shown, a drive shaft 91 extending forwardly through the front plate 83, as shown in FIGS. 11–13. The drive shaft 91 is held at one end thereof by an arm 93 pivotally supported by a shaft 92 and includes a support piece 94 of the crucifix form for supporting the petal type print wheel 28. The arm 93 includes an intermediate portion formed of a magnetic material, and electromagnets 95 and 96 are mounted above and below the intermediate portion respectively. The arm 93 is formed at its forward end portion with an engaging cutout 97 of the spline type which has engaged therein a plate spring 99 secured by a screw 98 to the front plate 83 at one end thereof. The arm 93 is normally held in a neutral position as shown in the figure by the biasing force of the plate spring 99. As one of the electromagnets 95 and 96 is selectively energized, the arm 93 shifts vertically toward the energized electromagnet. Stoppers 101 and 102 are located in upper and lower positions of the drive shaft 91 respectively, so that the upward and downward movements of the arm 93 are restricted by the stoppers 101 and 102.

Figure 15:
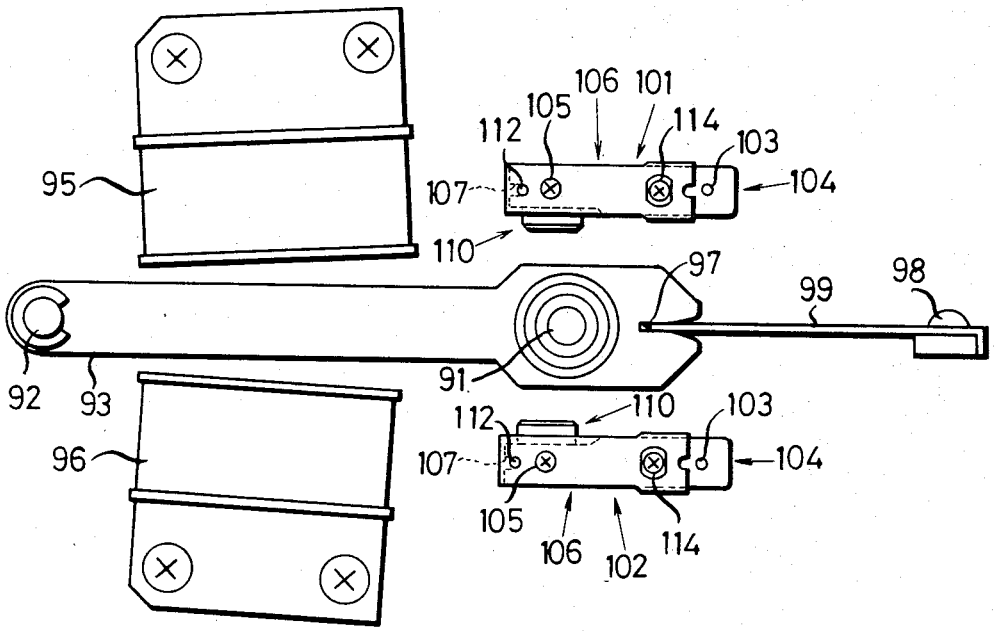
FIG. 15 is a front view of the print wheel shifting means.
Figure 16:
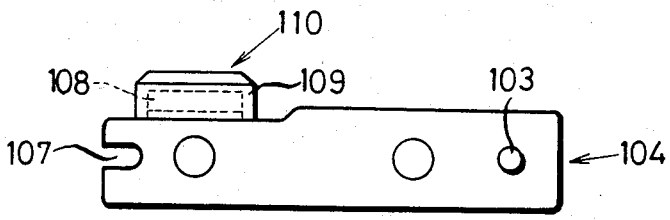
FIG. 16 is a front view of the base member (104) shown in FIG. 15.
Figure 17:
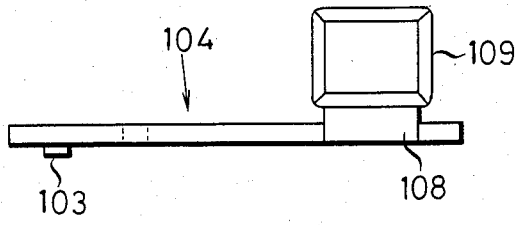
FIG. 17 is a side view of the base member shown in FIG. 16.
Figure 18:
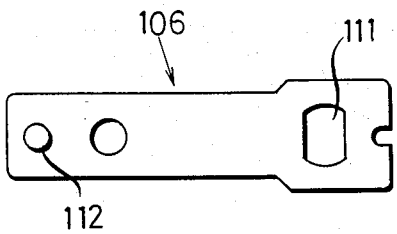
FIG. 18 is a plan view of the adjusting member (106) shown in FIG. 15.
Figure 19:
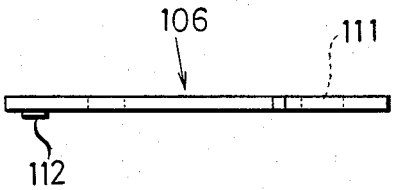
FIG. 19 is a side view of the adjusting member shown in FIG. 15.

Referring to FIG. 15, the stoppers 101 and 102 each comprise a base member 104 pivotable about a projection 103 at one end thereof, and an adjusting member 106 connected to the base member 104 through a screw 105. As shown in FIGS. 16 and 17, the base member 104 is formed with a cutout 107 at the other end thereof, and has a stopper 108 extending upwardly from its side facing the arm 93. The stopper 108 is covered with a shock absorbing member 109 to constitute a stopper member 110. As shown in FIGS. 18 and 19, the adjusting member 106 is formed at its major width portion at one end thereof with a slot 111 having its major dimension arranged in the widthwise direction and at the other end portion with a projection 112 extending toward the base_member 104 for engagement in the engaging cutout 107.

By pivotally moving the adjusting member 106 about the engaging projection 112, the base member 104 can be moved by the engaging projection 112 of the adjusting member 106 about the projection 103, so as to thereby effect fine adjustments of the position of the stopper member 110. After the stopper member 110 is positioned, the base member 104 is secured in place on the carriage 27 by inserting a screw 114 through the slot 111 of the adjusting member 106 into the front plate 83 (FIG. 13) of the carriage 27.

Figure 20:
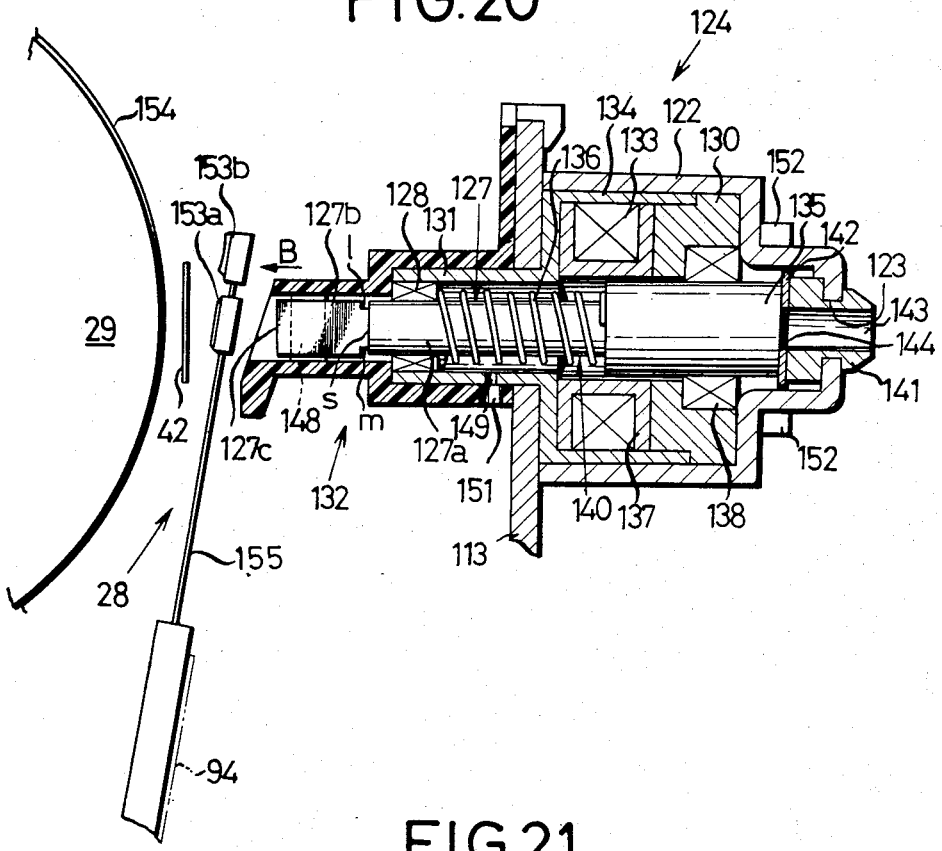
FIG. 20 is a sectional side view of the hammer device.
Figure 21:
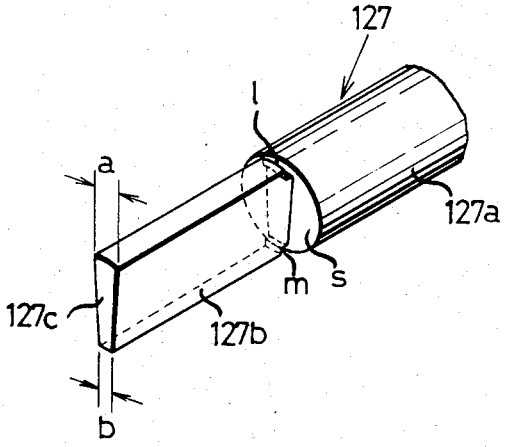
FIG. 21 is a perspective view of the striking member (127) of the hammer device shown in FIG. 20.

Referring to FIGS. 11–13 again, a hammer device 124 is secured to an inclined mounting surface 113 located in an upper portion of the front plate 83. As shown in FIG. 20, the hammer device 124 is mounted on the front plate 83 in such a manner that a forward cylindrical portion 131 of a front yoke 134 penetrates the mounting surface 113 (FIG. 13) of the front plate 83. The front yoke 134 encloses a coil 133 wound on a bobbin 137 and has a bearing 128 at the forward end of the cylindrical portion 131. Connected to the rear end of the front yoke 134 is a rear yoke 130 having a bearing 138 secured thereto. A striking member 127 and a plunger 135 integral with the striking member 127 constitute a hammer 140 journalled by the bearings 128 and 138. As shown in FIG. 21, the striking member 127 includes a rod-shaped base 127*a, and a plate-shaped portion 127b* extending from the forward end of the rod-shaped base 127*a* in such a manner that the rod-shaped base 127*a* has its opposite side portions removed to leave a space S at the forward end thereof. At the forward end of the rod-shaped base 127*a*, peripherally extending arcuate grooves l and m are formed in the upper and lower portions of the root of the plate-shaped portion 127*b* which has two opposite sides converging in going from top to bottom so that the upper end has a width a larger than the width b of the lower end. Thus the forward end of the plate-shaped portion 127*b* has a forward end surface 127*c* which has two opposite sides tapering in going from top to bottom.

Referring to FIG. 20, the front yoke 134 and the rear yoke 130 are covered with a heat-resisting cover 122 formed of heat-resistant synthetic resinous material, such as 6-nylon (containing 30 wt% of glass fiber), which is formed at its rear end with an opening 123 fitted therein with a shock absorber 141 formed of rubber. A compression spring 136 is mounted between the plunger 135 and the bearing 128 and urges by its biasing force the plunger 135 to press against the shock absorber 141 through a washer 142 formed as of polyester. The washer 142 is intended to prevent the plunger 135 being stuck to the shock absorber 141 to thereby enable the former to move in smooth reciprocatory movement. The shock absorber 141 and washer 142 are formed in the central portions thereof with ventilating apertures 143 and 144 respectively.

Figure 22:
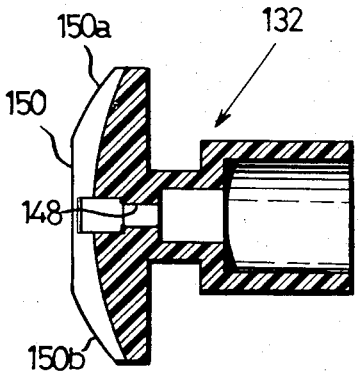
FIG. 22 is a sectional plan view of the protector (132) shown in FIG. 20.
Figure 23:
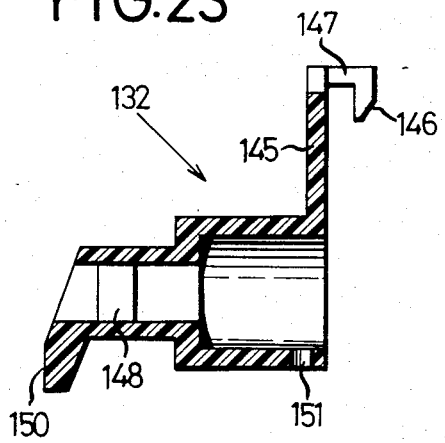
FIG. 23 is a sectional side view of the protector shown in FIG. 22.
Figure 24:
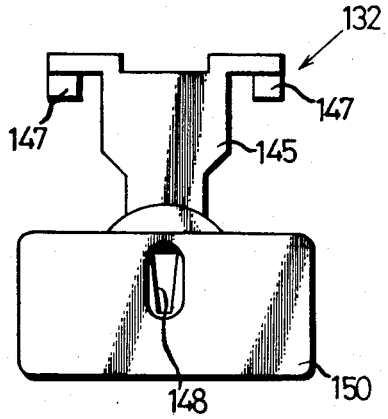
FIG. 24 is a front view of the protector shown in FIG. 23.

The cylindrical portion 131 has a protector 132 fitted over it which, as shown in FIGS. 22–24, is formed with an engaging portion 145 at its rear end which has at its upper end a pair of arms extending horizontally leftwardly and rightwardly (FIG. 24) and having resilient claws 147 each with an inclined surface 146 at the ends thereof. The protector 132 has a front surface formed as a guide surface 150 having side portions 150*a* and 150*b* retreating from the level of the central portion thereof. The protector 132 is formed of synthetic resinous material of high wear resistance and a low coefficient of friction, such as fluorine-containing polyacetal resin (trade name, DELRIN-AF made by du Pont Company). In fitting the protector 132 over the cylindrical portion 131 (FIG. 20), the cylindrical portion 131 is inserted in the protector 132 and the resilient claws 147 are automatically expanded outwardly by the resilience thereof through the inclined surfaces 146 on the inclined mounting surface 113. As the resilient claws 147 in the expanded condition are further moved, they are bent inwardly by the resilience thereof as they reach the right end of the inclined mounting surface 113, so that the resilient claws 147 are locked in position on the inclined mounting surface 113 to thereby securedly hold the protector 132 in position. In this way, the protector 132 can be positively and simply secured to the cylindrical member 131 without requring to use a screw or other clamping means. It is to be understood that the greater the length of the arms having the resilient arms 147 and extending leftwardly and rightwardly, the mcre stabilized is the manner in which the protector 132 is secured to the cylindrical member 131. Meanwhile the protector 132 is formed at its forward end with a guide opening 148 having opposite sides converging in going from top to bottom so that the plate-shaped portion 127*b* of the striking member 127 can be snugly fitted therein to avoid rotation of the striking member 127. An opening 149 formed in the lower portion of the cylindrical portion 131 and an opening 151 formed in the lower portion of the protector 132 are ventilating openings. The heat-resisting cover 122 is formed at its rear end portion with ribs 152 for reinforcing the cover 122.

Referring to FIG. 20 again, the forward end surface 127*c* of the striking member 127 is positioned against the paper 154 set on the platen 29 through a type member 153*a* and the ribbon 42 (FIG. 6) with the carriage 27 ( FIG. 13 ) being set on the carrier 26 (FIG. 4) by the setting means 51. The type member 153*a* is supported at the forward end of a finger 155 of a petal type print wheel 28 (FIG. 3). In the embodiment shown and described hereinabove, another type member 153*b* is located on the finger 155 outwardly of the type member 153*a*. As described hereinabove, the print wheel 28 is supported by a support member 94 (FIG. 13) of the carriage 27. Although the support member 94 and the hammer device 124 are both mounted on the front plate 83 (FIG. 13) of the carriage 27, they are mounted at angles different from each other. The reason why the inclined mounting surface 113 for mounting the hammer device 124 is inclined with respect to the front plate 83 is because it is desired to realise the aforesaid differences in mounting angle. In the figure, the hammer device 124 is shown as striking the type member 153*a*. However, when the type member 153*b* is to be struck, the lower electromagnet 96 shown in FIG. 13 is energized to shift the arm 93 downwardly, to thereby move the support member 94 and hence the print wheel 28 downwardly.

Referring to FIGS. 11–13 again, ribbon guides 156 are secured on opposite sides of the hammer device 124 and connected at opposite ends thereof to the front plate 83. The ribbon guides 156 each include an intermediate portion serving as a guide surface 157 for guiding the ribbon 42 and having a grip 158 attached to its upper portion. The grips 158 serve the purpose of pivotally moving the carriage 27 about the shafts 85 and 86. More specifically, when it is desired to set the carriage 27 to the printing position or to release it therefrom and pivotally move same upwardly, it is possible to attain the end by holding the grips 158 and performing the necessary operation. The reason why the carriage 27 is pivotally moved upwardly is because it is desired to facilitate attaching and detaching of the support member 94 to the print wheel 28.

Figure 25:
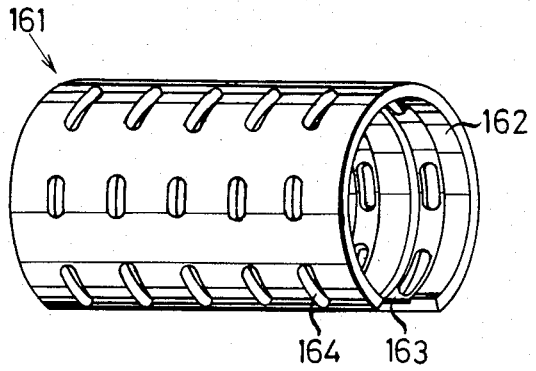
FIG. 25 is a perspective view of the motor cover.

As aforesaid, the drive shaft 91 for driving the print wheel 28 and the motor 89 located at the back of the front plate 83 are connected together by a universal joint, not shown. The provision of the universal joint ensures that even when the type wheel 28 is moved up and down, the output of the motor 89 is positively transmitted to the drive shaft 91 at all times. A cover 159 formed of synthetic resinous material for preventing dust collection is mounted above the position in which the universal joint is located and beneath the hammer device 124. As shown in FIG. 25, a motor cover 161 formed of synthetic resinous material of low heat conductivity, such as PBT resin (containing 30 wt% of glass fiber) is fitted over the outer periphery of the motor 89 and formed with a plurality of circumferentially extending rib-like protuberances 162 spaced apart axially by small thickness portions 163 formed with a plurality of heat-dissipating apertures 164 arranged circumferentially of the cover 161.

By fitting the cover 161 over the motor 89, it is possible to prevent the operator suffering burns even if the hands are brought into direct contact with the motor 89. The provision of the protuberances 162 on the inner surface of the cover 161 which are partly brought into contact with the outer periphery of the motor 89 and the heat-dissipating apertures 164 in the cover 161 enables heat to be satisfactorily released from the motor 89, so that the motor 89 is free from the danger of having trouble due to overheating. In the embodiment shown and described hereinabove, the motor cover 162 and joint cover 159 are mounted separately. However, the invention is not limited to this specific form of the covers 162 and 159 and the two covers 162 and 159 may be formed as a unitary structure. The numeral 165 in FIGS. 11–13 designates cartridge supports formed by bending opposite ends of the front plate 83 forwardly and fitting a vibration absorbing member 166, such as rubber, to each of the forwardly bent end portions.

Figure 26:
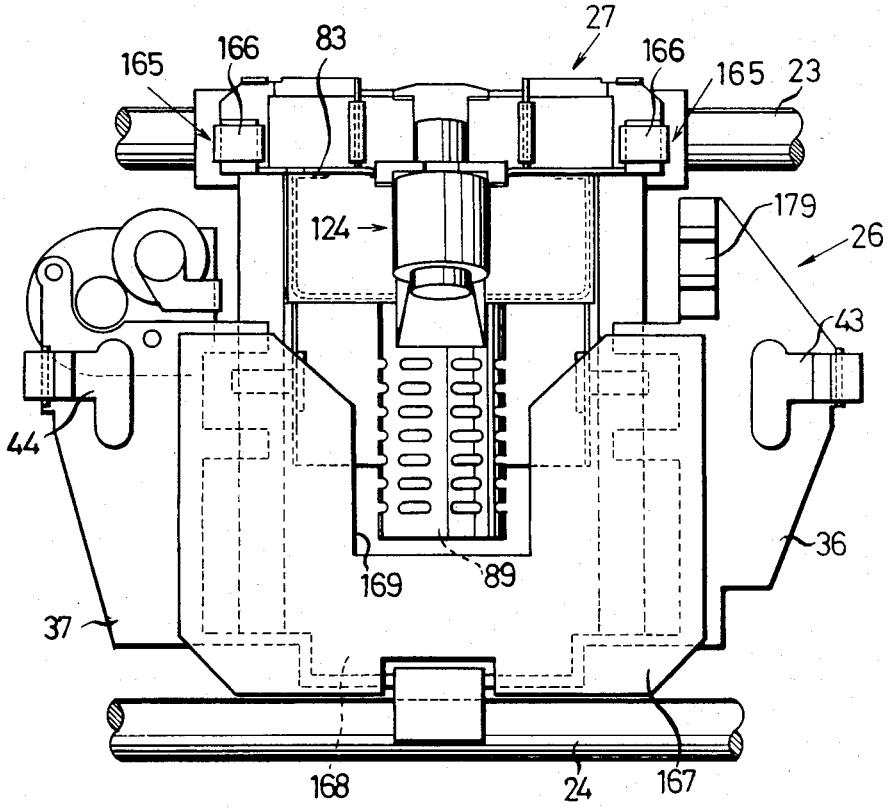
FIG. 26 is a plan view of the carrier mounting the carriage thereon.

FIG. 26 shows the carriage 27 as mounted on the carrier 26 as seen from above. A member 167 extending from the support plate 36 to the support plate 37 is a cover for closing a space 168 in the carrier 26 which is disposed posterior to the carriage 27. The cover 167 is provided at its undersurface with engaging claws, not shown, formed of flexible material and engageable with the support plate 36 or 37 to thereby support the cover 167 on the support plates 36 and 37. When the engaging claws are released from engagement with the support plate 36 or 37, the cover 167 can be detached from the support plates 36 and 37. The reason why the detachable cover 167 is attached to the support plates 36 and 37 is because it is desired to keep the wires located in a rearward portion 168 of the carriage 27 for driving the motor 89 and hammer device 124 from being viewed from outside. Suppose that the cover 167 is not provided. Then the wires and connectors for connecting them would be exposed and the operator would be seized with unnecessary fear when the cartridge 41 (FIG. 6) is replaced by a new cartridge. In the cover 167, a portion 169 disposed above the motor 89 is recessed to provide relief for avoiding the motor 89 striking the cover 167 when the carriage 27 is lifted.

Figure 27:
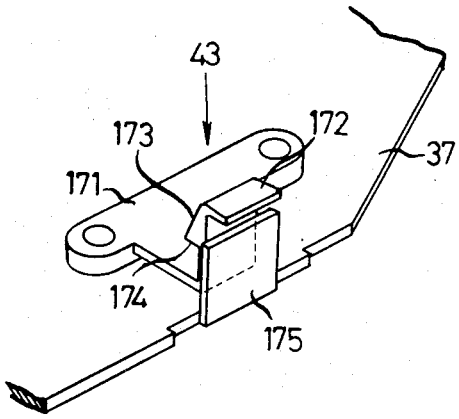
FIG. 27 is a perspective view of the cartridge fixing member.

The ribbon cartridge 41 shown in FIG. 6 is secured on the support plates 36 and 37 and the cover 167 by the cartridge securing members 43 and 44. They are of the construction presently to be described. The cartridge securing member 43, for example, is shown in FIG. 27 in which the member 43 includes a base 171 and an engaging tongue 172 of flexible material formed integrally with the base 171 in an upstanding position. The engaging tongue 172 includes a tilting surface portion 173 and an engaging projection 174 formed in its upper portion. A wall 175 on one side of the support plate 37 is spaced apart by a small clearance from the engaging tongue 172. Meanwhile, in FIG. 6, the cartridge 41 is formed with an engaging projection 176 adapted to engage the engaging projection 174 of the cartridge securing member 43 or 44 and walls 177 disposed anterior and posterior to the engaging projection 176 to position the engaging projection 174.

By virtue of the aforesaid construction of the cartridge 41 and the cartridge securing members 43 and 44, the cartridge 41 can be attached as follows. After placing the engaging projection 176 of the cartridge 41 on the engaging tongue 172 of the cartridge securing members 43 and 44, and cartridge 41 is moved downwardly. The engaging projection 176 moves downwardly along the tilting surface portion 173 while spreading the engaging tongue 172. As the engaging projection 176 reaches the engaging projection 174, the engaging projection 174 is narrowed by its resilience into engagement with the engaging projection 176, thereby completing attaching of the cartridge 41. The engaging tongue 172 that is spread is kept from being spread by the walls 175 on the support plates 36 and 37 more than is necessary, so that its flexibility is not spoiled.

In FIG. 6, the cartridge 41 is formed at one end portion with a slot 178 for allowing the intermittently fed ribbon 42 to pass therethrough. The ribbon 42 passed through the slot 178 is subjected to photoelectric check by a photosensor 179 shown in FIG. 26. Generally a ribbon includes a transparent tape connected to the trailing end portion of the ribbon. Thus as the ribbon 42 is nearly used up and the transparent tape reaches the photosensor 179, the latter detects the presence of the transparent tape and informs the operator that the ribbon 42 is nearing its end.

The cartridge supports 165 at the opposite sides of the front plate 83 support the cartridge 41 as the latter is attached to the printer as described hereinabove. The provision of the vibration absorbing member 166 keeps the vibration of the carrier 26 and carriage 27 from being transmitted to the cartridge 41.

In the embodiment shown and described hereinabove, the carrier 26, carriage 27 and various means associated therewith are constructed as aforesaid. By virtue of this constructional feature, the carriage 27 can be pivotally moved upwardly by holding and lifting the grips 158 (FIG. 13), to attach the print wheel 28 to the support member 94 of the crucifix form. The carriage 27 on the carrier 26 can be set at the printing position by the setting means 51 (FIG. 4) by moving the grips 158 downwardly. Then the ribbon cartridge 41 can be attached to the carrier 26, thereby enabling the printer to stand by for a printing operation, as shown in FIG. 20. Thereafter, by actuating the motor 89, a desired type member can be brought to a position in front of the hammer device 124. At this time, the finger 155 of the print wheel 28 rotated by the motor 89 reaches the position in front of the hammer device 124 by passing along the retreating side portion 150*a* or 150*b* of the guide surface 150 of the protector 132, so that rotation of the print wheel 28 can take place smoothly, and the spacing between the type member (designated by the numeral 153*a* as shown) in front of the hammer device 124 and the striking member 127 can be kept substantially constant at all times.

By passing a current to the coil 133 while the parts are in the aforesaid positions, a magnetic flux is produced that passes through the front yoke 134, plunger 135 and rear yoke 130, so that the plunger 135 is attracted and the hammer 140 moves in the direction of an arrow B against the biasing force of the compression spring 136. The hammer 140 moved in this way causes the type member 153*a* to strike the paper 154 on the platen 29, to thereby print a character on the paper 154. When the current passed to the coil 133 is interrupted, the hammer 140 is moved by the biasing force of the compression spring 136 in a direction opposite the direction of the arrow B, and comes to a halt when it abuts against the shock absorber 141 secured to the heat-resisting cover 122 through the washer 142. Thus the heat-resisting cover 122 performs the function of receiving the hammer 140 returned by the biasing force of the spring 136. During the aforesaid operation, the coil 133 to which a current is passed may generate heat and the front and rear yokes 134 and 130 may be heated thereby. However, since these parts are covered in the heat-resisting cover 122, there is no risk of the operator suffering burns even if the operator directly touches the hammer device 124. Thus the heat-resisting cover 122 has the dual function of resisting the heat generated in the coil 133 and serving as a back-stop for the hammer 140.

Figure 28:
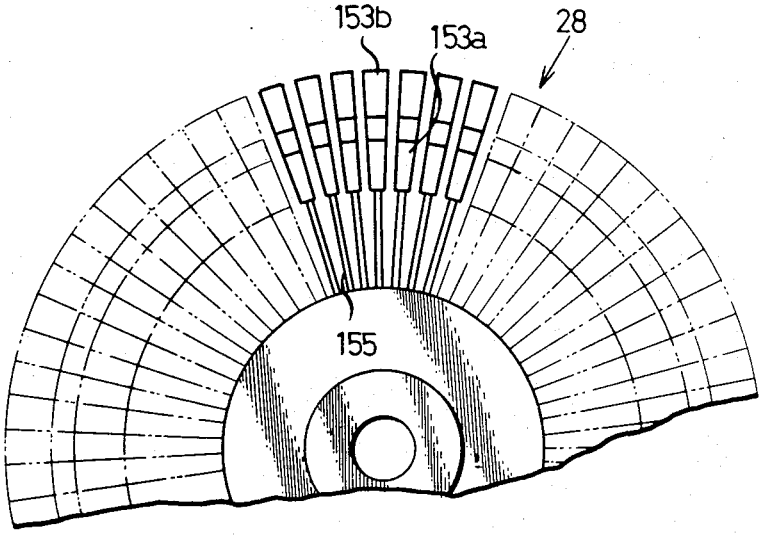
FIG. 28 is a front view, with certain parts being broken away, of a petal type print wheel having two rows of type members arranged in upper and lower rows.

During the aforesaid printing operation, the striking member 127 of the hammer 140 moving in reciprocatory movement in the direction B and a direction opposite the direction B has the rotation of its plate-shaped portion 127*b* at its forward end prevented by the guide opening 148 (FIGS. 22–24) formed in the protector 132. This enables the forward end surface 127*c* of the striking member 127 to positively strike the type member 153*a* without coming into contact with the type members adjacent the type member 153*a*. The reason why the forward end surface 127*c* has opposite sides tapering in going from top to bottom is as follows. In the petal type print wheel 28 (FIG. 20), the type members 153*a* and 153*b* are arranged in two positions spaced apart axially of the finger 155, so that, as shown in FIG. 28, the type member 153*a* of the lower position has a smaller width than the type member 153*b* of the upper position. This is why the forward end surface 127*c* is shaped as shown and described hereinabove. In order that the printing operation may be performed positively, it is desirable that the forward end surface 127*c* of the striking member 127 be shaped as described hereinabove. However, the invention is not limited to this specific form of the forward end surface 127*c* and printing can, of course, be carried out even if the forward end surface 127*c* is rectangular in shape . It would be necessary, when this is the case, to form the guide opening in the protector 132 in a shape that conforms to that of the forward end surface 127*c* of the striking member 127.

In the present invention, the guide opening 148 formed in the protector 132 performs the function of preventing the striking member rotating on its own axis. This eliminates the need to have the bearing 128 perform the additional function of preventing the striking member rotating on its own axis, so that the need to work on the bearing 128 to impart the aforesaid specific shape involving an incomplete cross-sectional shape thereto can be eliminated and a bearing of an ordinary shape circular in cross section can be used for the bearing 128. The use of the bearing 128 circular in cross section simplifies working on the bearing and enables precision finishes to be readily imparted thereto. Moreover, the bearing 128 of this shape has high durability, so that the hamxer device using such bearing can be readily fabricated, can produce printed characters of high quality, and can have a prolonged service life. Moreover, the function of preventing rotation of the striking member about its own axis is performed by the protector 132 and the bearing 128 has only to perform its essential function of journalling the striking member 127 which moves in sliding reciprocatory movement. Thus the load applied to the bearing is markedly lessened and the service life of the hammer device can be further prolonged.

In performing printing, the striking member 127 strikes the platen through the ribbon 42. At this time, the ink with which the ribbon 42 is impregnated may be scattered as the striking member 127 impinges thereon and adhere to the forward end of the striking member 127. The ink deposited on the forward end of the striking member 127 may gradually flow therealong to its rear end portion. This disadvantage can be obviated according to the invention by the provision of the peripherally-extending arcuate grooves l and m and the space S provided to the striking member 127. The ink flowing rearwardly along the striking member 127 is checked by these grooves and space and kept from reaching the bearing 128. Thus smooth operation of the striking member 127 and hence the hammer 140 is ensured over a prolonged period of time.

The plunger 135 is forced against the shock absorber 141 by the biasing force of the spring 136. Repeated performance of this action will apply a considerably high load to the rear portion of the heat-resisting cover 122. The ribs 152 formed in the rear portion of the heat-resisting cover 122 are intended to avoid damage that might otherwise be caused to the heat-resisting cover 122.

The ventilating openings 143 and 144 formed in the shock absorber 141 and washer 142 and the ventilating openings 149 and 151 formed in the lower portion of the cylindrical portion 131 of the front yoke 134 and the lower portion of the protector 132 respectively are intended to allow air to be discharged therethrough when the plunger 135 moves in reciprocatory movement. The provision of these ventilating openings enables the plunger 135 to move smoothly in its reciprocatory movement.

In the embodiment of the invention shown and described hereinabove, the petal type print wheel 28 is constructed to have type members arranged in two layers spaced apart axially of the fingers. It is to be understood that the hammer device according to the invention can also be incorporated in a printer having a print wheel with type members arranged in one layer extending peripherally.

Figure 29:
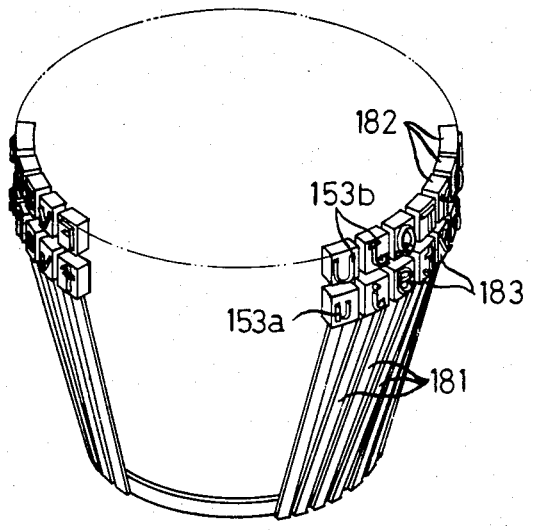
FIG. 29 PRIOR ART
FIG. 29 is a perspective view of another form of petal type print wheel.

The petal type print wheel with which the hammer device according to the invention can be used is not limited to the circular disc type print wheel shown and described hereinabove, and the hammer device according to the invention can be used with any other form of petal type print wheel, such as a bowl type print wheel shown in FIG. 29 including a multiplicity of spokes 181 arranged along a cylindrical or frustoconical surface and each having seats 182 and 183 thereon for supporting type members 153*a* and 153*b* respectively.

What is claimed is:

1. In a printer hammer device comprising a striking member supported in a support frame mounted on a carriage and positioned adjacent a platen of a printer for axial reciprocatory movement relative to a plurality of type members supported on fingers of a rotatable print wheel, said striking member being operative to strike a type member at its back and force the type member against an ink ribbon to impact against a paper positioned on the platen so as to print a character on the paper, the improvement wherein said striking member has a striking end element joined at one end to said striking member and adapted at its other end for striking said type member, and means for preventing ink from contaminating the support frame of the hammer device including a peripherally extending groove located at the joinder of said one end of said striking end element with said striking member.

2. A printer hammer device of the type having a striking member supported in a support frame mounted on a carriage and positioned adjacent a platen of a printer for axial reciprocatory movement relative to a plurality of type members supported on fingers of a rotatable print wheel, said striking member having a striking surface and being operative to strike a type member at its back against a paper positioned on the platen so as to print a character on the paper, comprising:

a guide member mounted on a forward portion of said support frame and having means, including a guide opening, for guiding said striking member in said axial reciprocatory movement and for preventing said striking member from rotational movement about its axis, the striking surface of said striking member, in its rest position, being recessed within said guide opening, and means for preventing the type members of said rotatable print wheel from colliding with said striking member, including a protector member below said guide opening integrally formed with a lower portion of said guide member and extending forwardly of the guide opening toward said print wheel, said protector member having guide portions extending laterally to both sides from said guide opening, said guide portions having guide surfaces inclined to the path of movement of said type members for guiding movement of said type members.

3. The printer hammer device described in claim 2, wherein said support frame includes a front plate extending laterally on both sides of said striking member, and said guide member further including a pair of arms extending laterally to each side and having means, including resilient claws on the ends of said arms, for positively engaging said front plate and locating said guide opening in an operative position relative to the type member.

4. The printer hammer device described in claim 2 or 3, wherein said guide member is formed of synthetic resinous material.

5. A hammer device as claimed in claims 1, 2, or 3 wherein said support frame is a cylindrical portion formed integrally with a yoke and extending therefrom, said yoke enclosing a coil for driving said striking member.

6. A hammer device as in any one of the claims 2 or 3 wherein said protector member has a ventilation opening which is aligned with a ventilation opening in said support frame.

7. A hammer device as claimed in claims 2 or 3, wherein said striking surface of said striking member is formed by two opposite sides which taper from top to bottom, and said guide opening also has two opposite sides tapering from top to bottom to conform to said tapered sides of the striking surface.

* * * * *